US011031703B2

(12) United States Patent
Liu et al.

(10) Patent No.: US 11,031,703 B2
(45) Date of Patent: Jun. 8, 2021

(54) ANTENNA UNIT AND ANTENNA SYSTEM

(71) Applicant: AAC Technologies Pte. Ltd., Singapore (SG)

(72) Inventors: Jianchuan Liu, Shenzhen (CN); Yuehua Yue, Shenzhen (CN); Hongjuan Han, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 36 days.

(21) Appl. No.: 16/524,061

(22) Filed: Jul. 27, 2019

(65) Prior Publication Data

US 2020/0052417 A1 Feb. 13, 2020

(30) Foreign Application Priority Data

Aug. 12, 2018 (CN) ..... 201810912482.6

(51) Int. Cl.

| | |
|---|---|
| ***H01Q 5/328*** | (2015.01) |
| ***H01Q 21/28*** | (2006.01) |
| ***H01Q 5/50*** | (2015.01) |
| ***H01Q 1/24*** | (2006.01) |
| ***H01Q 9/04*** | (2006.01) |

(52) U.S. Cl.

CPC ..... *H01Q 21/28* (2013.01); *H01Q 1/241* (2013.01); *H01Q 5/328* (2015.01); *H01Q 5/50* (2015.01); *H01Q 9/0407* (2013.01)

(58) Field of Classification Search

CPC ..... H01Q 21/28; H01Q 5/328; H01Q 5/50; H01Q 1/241; H01Q 9/0407; H01Q 21/30; H01Q 21/24; H01Q 25/001; H01Q 13/08; H01Q 1/38

See application file for complete search history.

(56) References Cited

U.S. PATENT DOCUMENTS

| | | | | |
|---|---|---|---|---|
| 6,421,014 | B1 * | 7/2002 | Sanad | H01Q 1/243 343/700 MS |
| 2006/0170596 | A1 * | 8/2006 | Habib | H01Q 9/26 343/700 MS |
| 2019/0319367 | A1 * | 10/2019 | Edwards | H01Q 1/243 |

FOREIGN PATENT DOCUMENTS

| | | | |
|---|---|---|---|
| CN | 1254202 | A1 | 12/2018 |

OTHER PUBLICATIONS

1st Office Action dated Nov. 8, 2019 by SIPO in related Chinese Patent Application No. 201810912482.6 (20 Pages)

* cited by examiner

*Primary Examiner* — Henry Luong
(74) *Attorney, Agent, or Firm* — W&G Law Group LLP

(57) ABSTRACT

An antenna unit, including a radiator, a dielectric layer and an antenna ground plane which are sequentially stacked. The radiator includes a first antenna unit and a second antenna unit that are opposite to, spaced apart from and structurally complementary to each other. The first antenna unit is provided with a feeding point connected to an external power source and two first grounding points connected to the antenna ground plane. The second antenna unit is provided with three second grounding points connected to the antenna ground plane. Compared with the related art, the antenna unit provided by the present disclosure works in the 37-42.5 GHz band, has a good antenna performance, wide working band, simple structure, and low profile, and is easy to implement.

6 Claims, 7 Drawing Sheets

ANTENNA UNIT AND ANTENNA SYSTEM

TECHNICAL FIELD

The present disclosure relates to the technical field of antennas, and in particular, to an antenna unit and an antenna system.

BACKGROUND

In wireless communication equipment, there is always a device that radiates electromagnetic energy into space and receives electromagnetic energy from space. This device is the antenna. The role of the antenna is to transmit a digital or analog signal modulated to the RF frequency to a spatial wireless channel, or to receive a digital or analog signal modulated at the RF frequency from a spatial wireless channel.

5G serves as the focus of research and development in the global industry, and the development of 5G technology and setting of 5G standard have become the industry consensus. At the ITU-RWP5D 22nd meeting convened by the international telecommunication union (ITU) in June 2015, it is clarified that there are three main application scenarios for 5G: enhanced mobile broadband, large-scale machine communication, and high-reliability low-latency communication. The three application scenarios respectively correspond to different key indexes, in which the peak rate of a user in the enhanced mobile bandwidth scenario is 20 Gbps, and the minimum user experience rate is 100 Mbps. The high carrier frequency and large bandwidth characteristics unique to millimeter waves are the main means to achieve 5G ultra-high data transmission rate.

Therefore, it is necessary to provide an antenna system suitable for future 5G technology.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
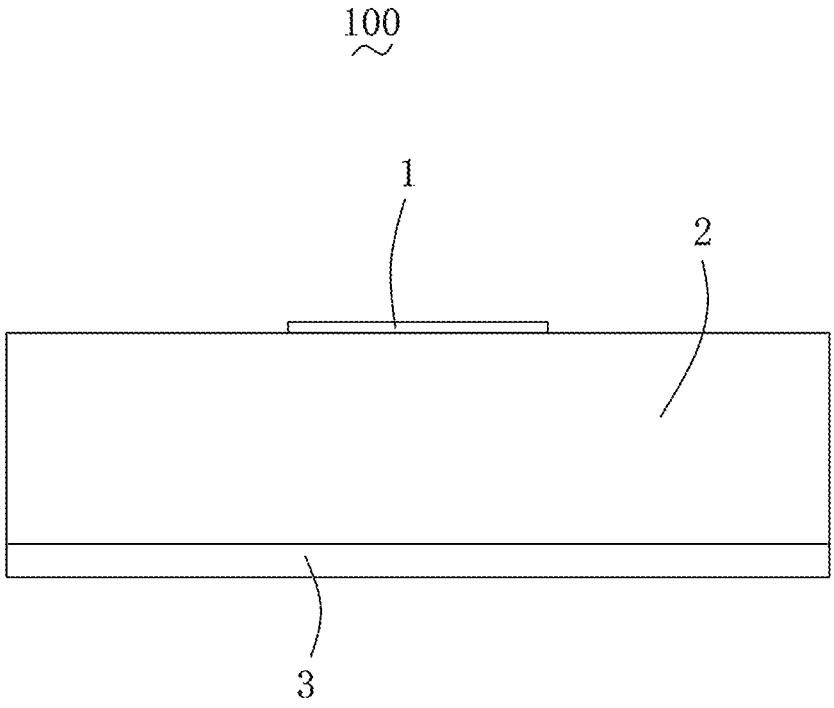
FIG. 1 is a structural schematic side view of an antenna unit according to the present disclosure.
Figure 2:
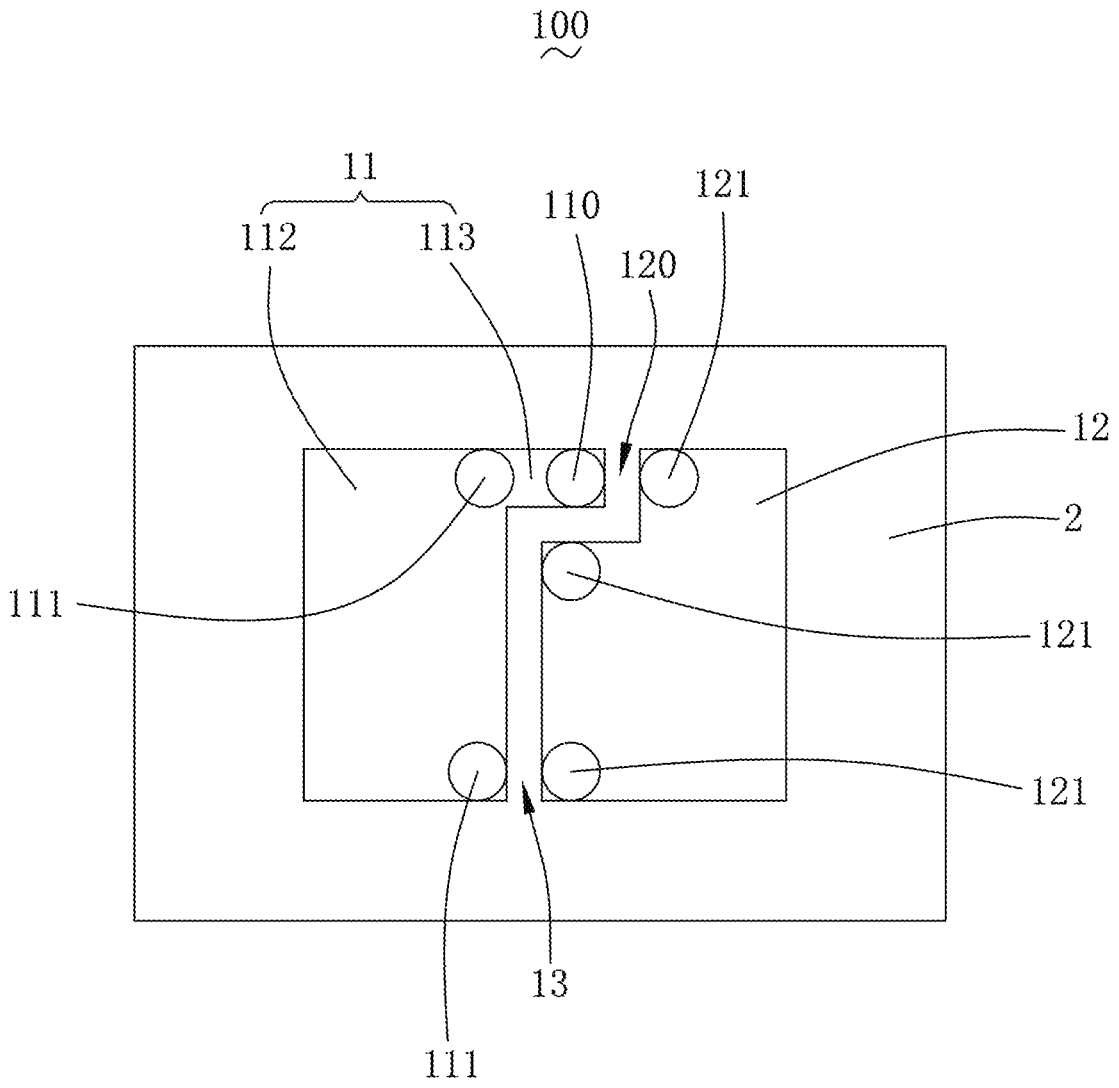
FIG. 2 is a structural schematic front view of the antenna unit according to the present disclosure.

With reference to FIG. 1 and FIG. 2, an embodiment of the present disclosure provides an antenna unit 100, including a radiator 1, a dielectric layer 2, and an antenna ground plane 3 which are sequentially stacked. The radiator 1 includes a first antenna unit 11 and a second antenna unit 12 which are spaced apart from and coupled to each other. The antenna unit 100 is a millimeter wave wideband antenna, and the coverage band is 37-42.5 GHz.

The first antenna unit 11 is provided with a feeding point 110 connected to an external power source and two first grounding points 111 connected to the antenna ground plane 3. For example, the first antenna unit 11 includes a rectangular body portion 112 and an extending portion 113 extending from a corner portion, close to the second antenna unit 12, of the body portion 112 towards the second antenna unit 12. The feeding point 110 is arranged at the extending portion 113, and the two first grounding points 111 are respectively arranged at two corner portions, close to the second antenna unit 12, of the body portion 112.

The second antenna unit 12 is provided with three second grounding points 121 connected to the antenna ground plane 3. The second antenna unit 12 includes a recess portion 120 arranged corresponding to the extending portion 113. Since the recess portion 120 is provided, the second antenna unit 12 forms four corner portions at one side close to the first antenna unit 11, and the three second grounding points 121 are respectively arranged at the three corner portions thereof. For example, two of the second grounding points 121 are located at opposite corners of the recess portion 120, and the remaining one of the second grounding points 121 is located at the corner portion facing away from the recess portion 120.

A coupling gap 13 is provided between the first antenna unit 11 and the second antenna unit 12, and the feeding point 110, the first grounding points 111, and the second grounding points 121 are arranged close to the coupling gap 13.

Figure 3:
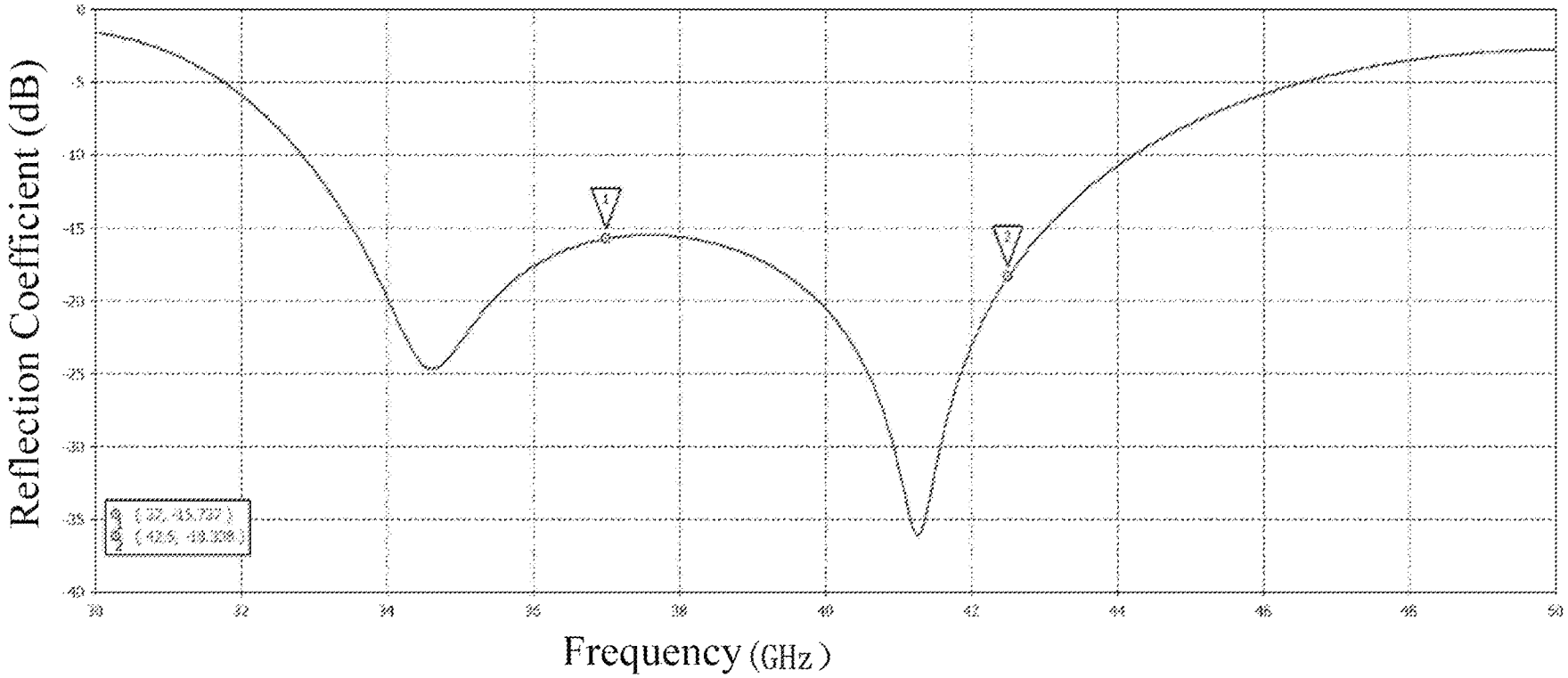
FIG. 3 is a reflection coefficient diagram of the antenna unit according to the present disclosure.
Figure 4:
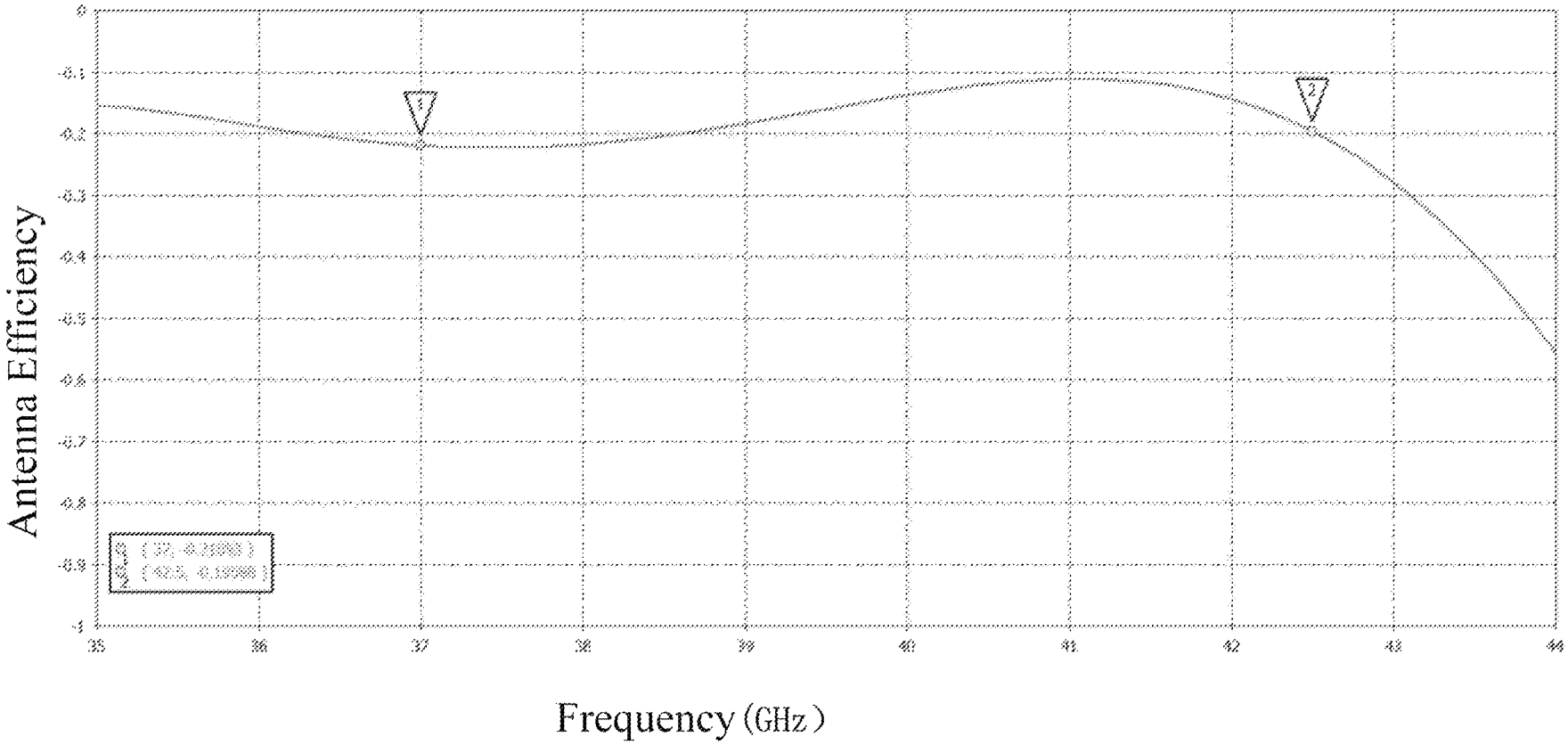
FIG. 4 is an overall antenna efficiency diagram of the antenna unit according to the present disclosure.
Figure 5:
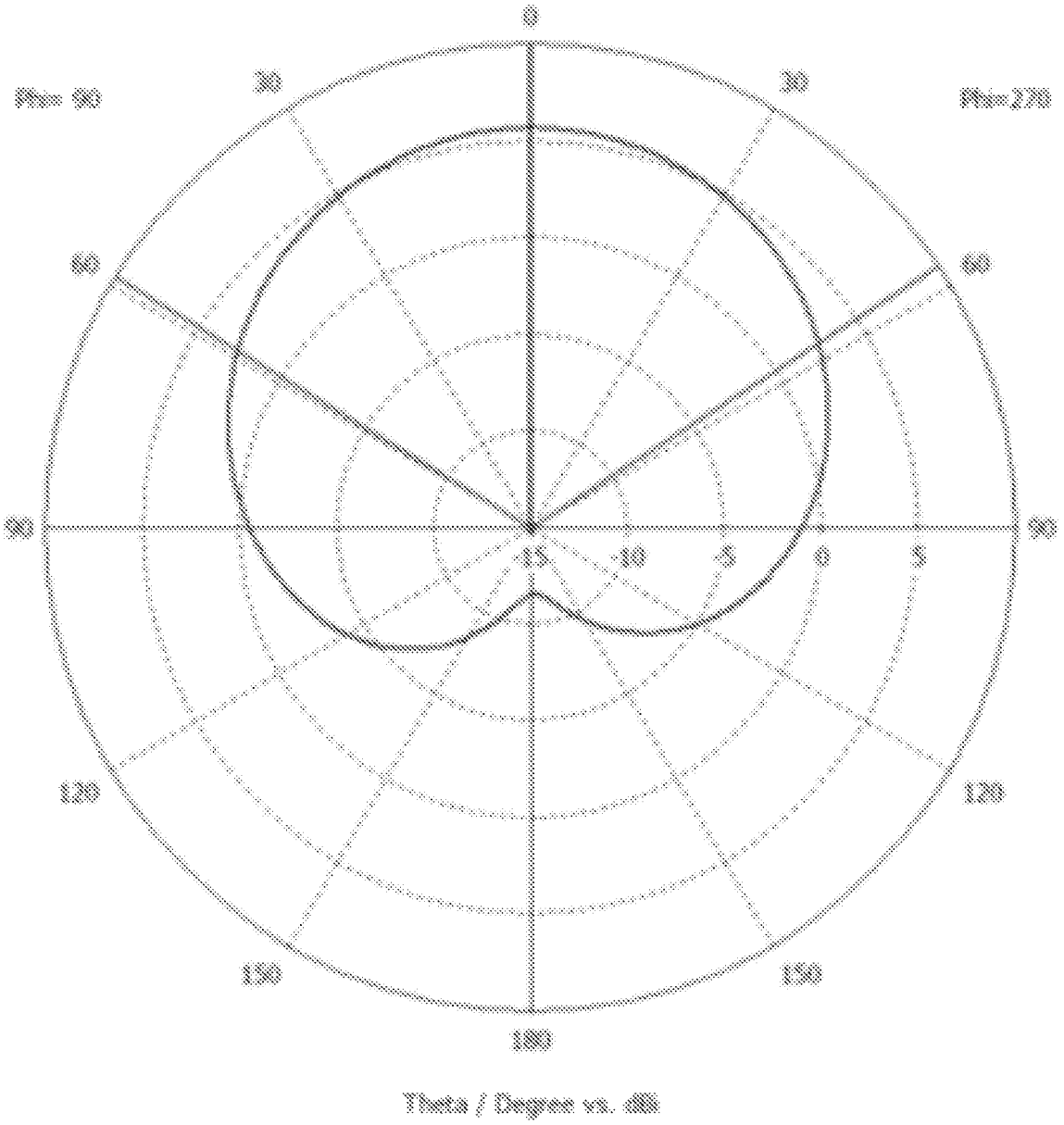
FIG. 5 is a radiation pattern of an E1 plane of the antenna unit according to the present disclosure.
Figure 6:
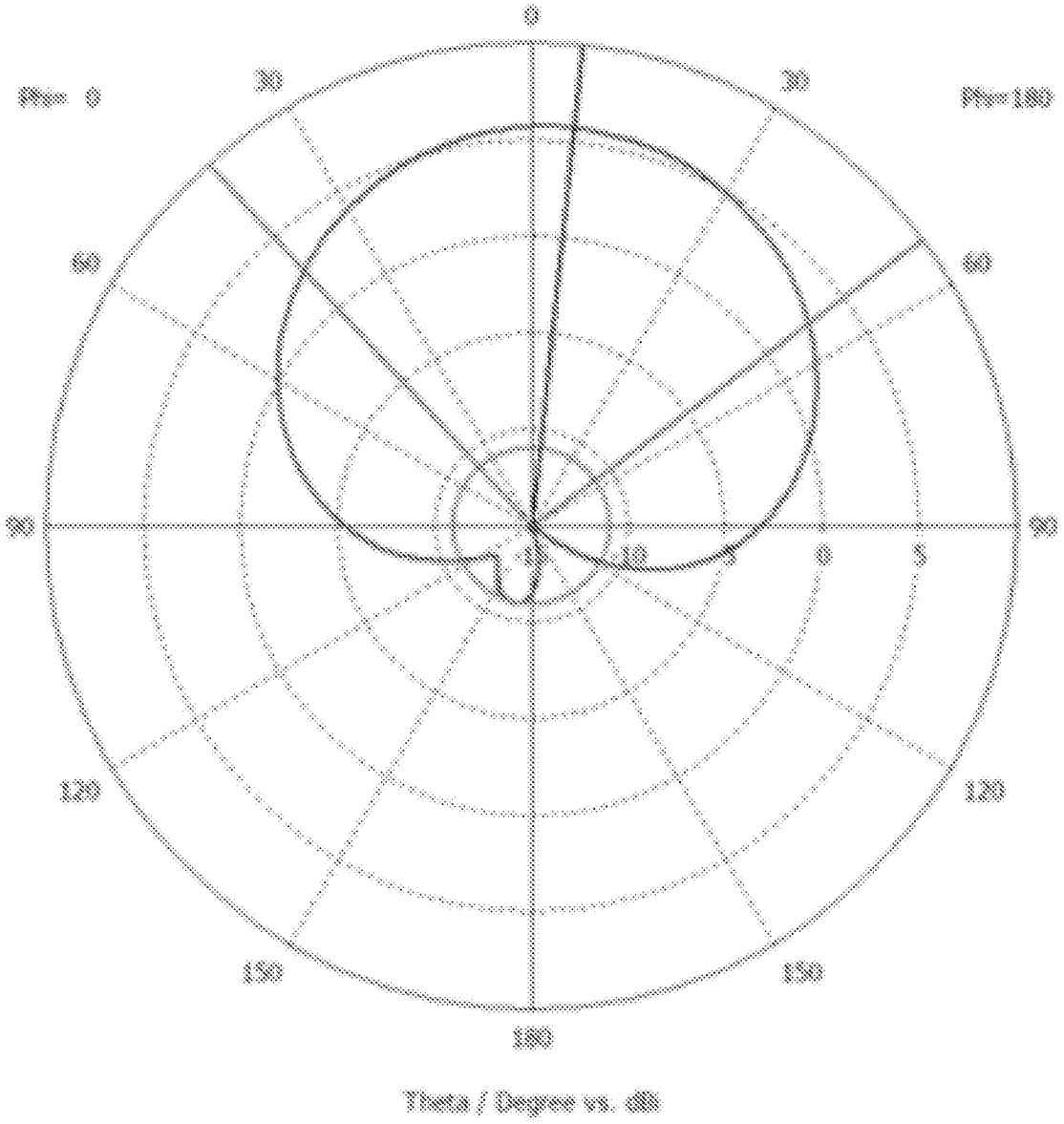
FIG. 6 is a radiation pattern of an E2 plane of the antenna unit according to the present disclosure.

The reflection coefficient of the antenna unit 100 is as shown in FIG. 3. It can be seen that the reflection coefficients are all less than −15 dB in the coverage band of 37-42.5 GHz of the antenna unit 100. The overall antenna efficiency of the antenna unit 100 is as shown in FIG. 4 in the coverage band of 37-42.5 GHz of the antenna unit 100. The radiation directions of the antenna unit 100 in an E1 plane and an E2 plane are as shown in FIG. 5 and FIG. 6, respectively.

Figure 7:
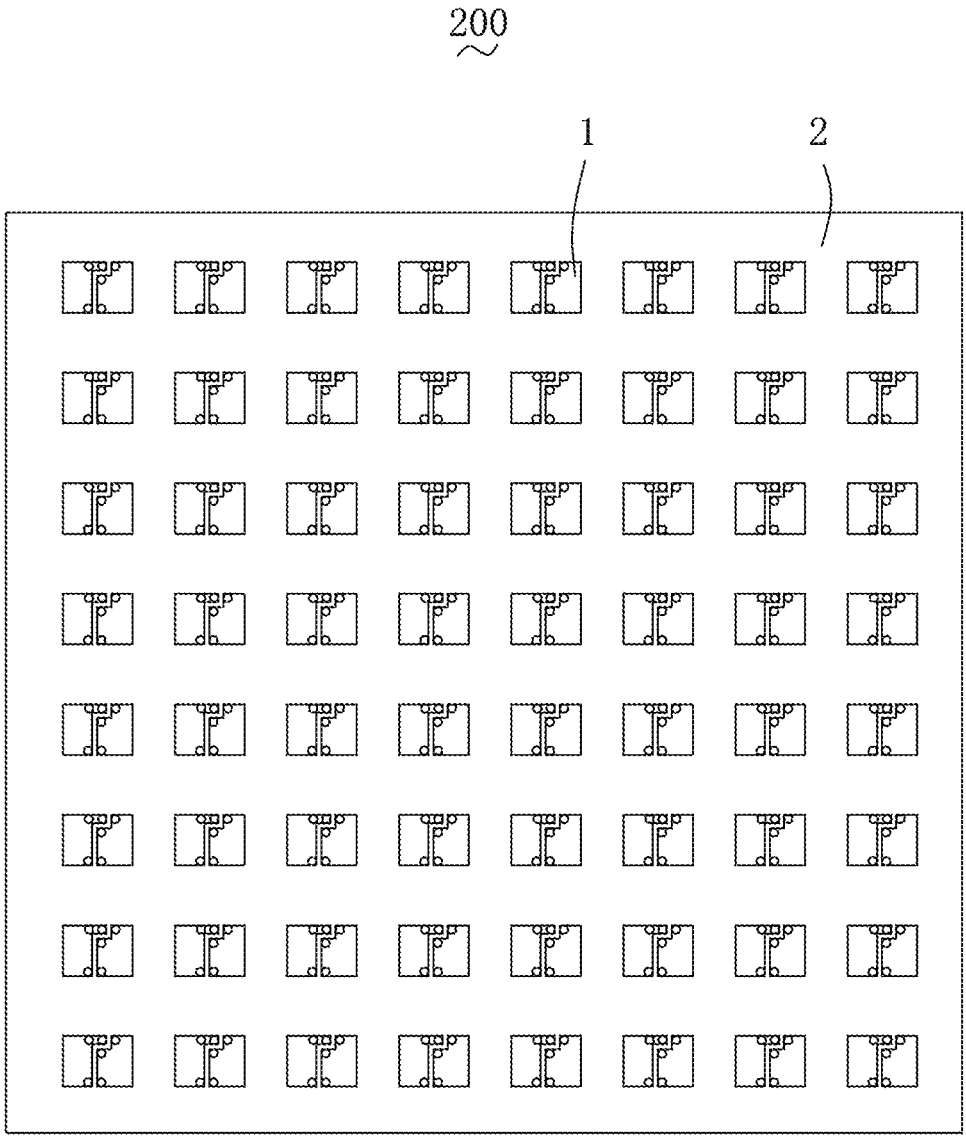
FIG. 7 is a schematic diagram of an array structure of an antenna system according to the present disclosure.

With reference to FIG. 2 and FIG. 7, the present disclosure also provides an antenna system 200, including the antenna unit 100. A plurality of radiators forms an array on the same dielectric layer 2. In FIG. 7, the antenna unit 100 forms an 8*8 planar array. It should be noted that, according to actual needs and installation environments, the antenna unit 100 may also form a larger or smaller planar array, or may form a linear array or three-dimensional array.

Compared with the related art, the antenna unit provided by the present disclosure works in the band of 37-42.5 GHz, has a good antenna performance, wide working band, simple structure, and low profile, and is easy to implement.

The above are merely the embodiments of the present disclosure, and it should be noted that those skilled in the art can also make improvements, without departing from the creative conception of the present disclosure, which all shall fall within the scope of the present disclosure.

What is claimed is:

1. An antenna unit, comprising:

a radiator comprising a first antenna unit and a second antenna unit that are disposed opposite to, spaced apart from and structurally complementary to each other;

a dielectric layer; and an antenna ground plane;

wherein the radiator, the dielectric layer and the antenna ground plane are sequentially stacked, the first antenna unit is provided with a feeding point connected to an external power source and two first grounding points connected to the antenna ground plane, and the second antenna unit is provided with three second grounding points connected to the antenna ground plane;

wherein a coupling gap is provided between the first antenna unit and the second antenna unit;

wherein the feeding point, the two first grounding points and the three second grounding points are arranged close to the coupling gap;

wherein the first antenna unit comprises a rectangular body portion and an extending portion extending from a corner portion, close to the second antenna unit, of the rectangular body portion towards the second antenna unit, and the second antenna unit comprises a recess portion arranged corresponding to the extending portion.

2. The antenna unit as described in claim 1, wherein the antenna unit covers a frequency band of 37-42.5 GHz.

3. An antenna system, comprising the antenna unit as described in claim 2.

4. The antenna unit as described in claim 1, wherein the feeding point is arranged at the extending portion, and the two first grounding points are respectively arranged at two corner portions, close to the second antenna unit, of the rectangular body portion.

5. The antenna unit as described in claim 4, wherein the three second grounding points are respectively arranged at three corner portions, close to the first antenna unit, of the second antenna unit.

6. An antenna system, comprising the antenna unit as described in claim 1.

* * * * *